US007066252B2

(12) United States Patent
Heijnen et al.

(10) Patent No.: US 7,066,252 B2
(45) Date of Patent: Jun. 27, 2006

(54) EROSION RESISTANT, SELF AND/OR ARTIFICIAL EXTERNAL CLEANING SOLID EXCLUSION SYSTEM

(75) Inventors: Wilhelmus Hubertus Paulus Maria Heijnen, Metairie, LA (US); Donald George Maynard, The Woodlands, TX (US)

(73) Assignee: Shell Oil Company, Houston, TX (US)

( * ) Notice: Subject to any disclaimer, the term of this patent is extended or adjusted under 35 U.S.C. 154(b) by 55 days.

(21) Appl. No.: 10/230,541

(22) Filed: Aug. 29, 2002

(65) Prior Publication Data

US 2004/0050217 A1 Mar. 18, 2004

(51) Int. Cl.
*E21B 43/08* (2006.01)

(52) U.S. Cl. ..... 166/227

(58) Field of Classification Search ..... 166/227, 166/228

See application file for complete search history.

(56) References Cited

U.S. PATENT DOCUMENTS 5,088,554 A * 2/1992 Arterbury et al. ..... 166/228
5,293,935 A * 3/1994 Arterbury et al. ..... 166/228
5,664,628 A * 9/1997 Koehler et al. ..... 166/369
6,554,064 B1 * 4/2003 Restarick et al. ..... 166/250.01

* cited by examiner

*Primary Examiner*—Hoang Dang
(74) *Attorney, Agent, or Firm*—Rachael A. Stiegel

(57) ABSTRACT

Disclosed is a tool having an axial passage, a top and a bottom, and a sidewall portion possessing porosity and permeability properties and constructed of a material having equal or better erosion properties than any substances produced and/or injected into any earth formation, said tool functioning as a filter to permit solids to pass or not pass depending upon their size, characterized in that the porosity and permeability can be programmed to any given value radially and longitudinally, said tool further including a means for circulating from outside, inward or from the inside outward to enable cleaning, wherein optionally said tool can be used in multiples.

8 Claims, 3 Drawing Sheets

EROSION RESISTANT, SELF AND/OR ARTIFICIAL EXTERNAL CLEANING SOLID EXCLUSION SYSTEM

FIELD OF THE INVENTION

This invention relates to solids exclusion. More particularly, this invention relates to a solids exclusion system that includes a filter characterized by porosity and permeability designed to optimize production at multiple specified intervals, and made of materials resistant to erosion by any solids and/or resistant against corrosion by any chemicals commonly used in drilling, or produced from, and/or injected into a well. In addition, the present invention makes it possible to circulate flow at the outside of the filter to remove any solids and/or fluids which can accumulate and prohibit flow; and, further, it can be employed to inject or produce any fluid and/or solids outside the filter. The invention can be used in any bore hole, lined or open hole, into any earth formation whether it is used for injection, production, and/or circulation of fluids, solids or any combination thereof.

BACKGROUND OF THE INVENTION

In the production of hydrocarbons from earth formations, wellbores are drilled into reservoirs or pay zones. Such wellbores are completed and perforated at one or more zones to recover hydrocarbons from reservoirs. Many oil and gas wells produce fluid from underground formations containing solid particles, which are loose and/or not strongly attached to each other and when hydrocarbon-containing fluid is produced, it tends to carry entrained solids with it. These solids can cause serious damage to well equipment due to erosion. Erosion is particularly bad when a disproportionate amount of flow is concentrated in a relatively small region, resulting in high velocities of the solids. These regions are called "hot spots".

Filters, normally called sand screens of various designs, and slotted liners are commonly placed opposite the formation and below the production tubing in the well bore preventing entry of solid particulates into the tubing. Filters of different makes and configurations are commonly used as solids control devices. Filters currently available in the art typically erode substantially over time. In addition, they cannot effectively produce all zones because of the fact that the pressure differential required varies over the zones, which creates "hot spots" as mentioned above. Furthermore, there is currently no method available of filter cleaning by circulation of fluids, with or without additives, outside the filter.

Filters are commercially available that are made of multiple layers of woven material sintered together into a porous rigid medium, however they are only available in several mesh sizes with only one mesh size available per filter, and they are subject to corrosion and/or erosion.

There is a great need in the art for a solid filter assembly that is resistant to all erosive chemicals and production fluids known in the petroleum industry to cause problems and that can deal effectively with all sizes of solids to optimize production, even where optimal production requires different permeabilities and porosities of the filter for different intervals vertically or radially. It would constitute a great advance in the art if the same filter assembly were designed such that well intervention and cleaning were possible by circulation at the outside of the filter.

SUMMARY

In accordance with the foregoing the present invention provides a solids exclusion system with features not currently available in the art, including being constructed of material resistant to erosion by any known fluids with or without any form of solids, and characterized by porosity and permeability targeted for optimal production in multiple zones, and an overall design that makes possible circulation at the outside of the filter to enable cleaning, and which likewise makes possible the injection or production of any fluid and/or solids from outside the filter.

The present invention is a solids exclusion system for preventing migration of solid particles, of a certain size, into a production well comprising a filter having an upper surface and a lower surface, positioned in a lined or unlined hole, characterized by variable porosity and permeability properties designed to optimize production at one or more intervals, and further comprising the filter is constructed of a material resistant to erosion by any chemicals commonly used in the petroleum industry or any naturally occurring well bore fluids produced from earth formations.

DETAILED DESCRIPTION OF THE INVENTION

Figure 1:
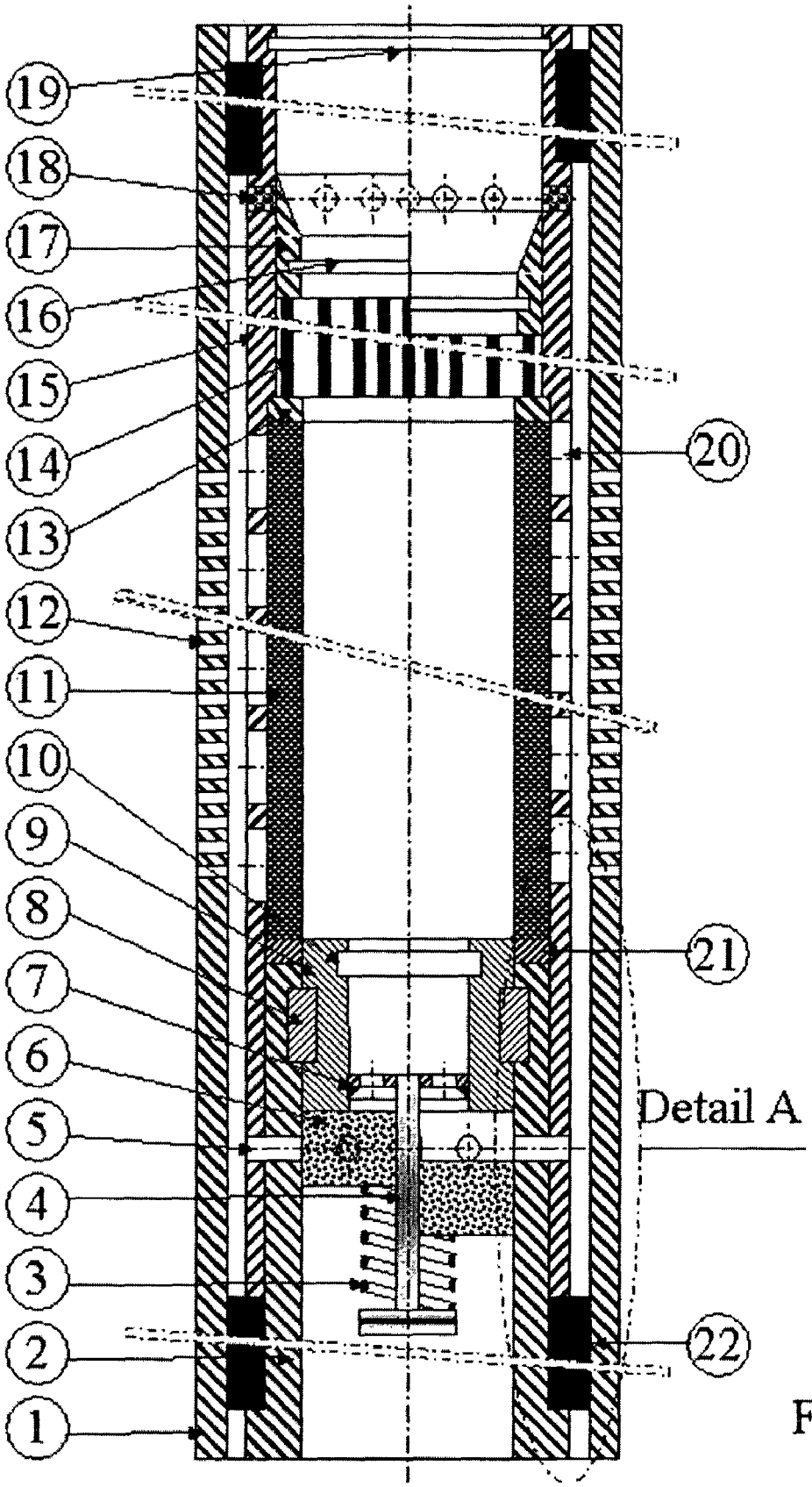
FIG. 1 is a longitudinal, cross-section view of one embodiment of the present invention.

The solids exclusion system of the present invention can be deployed in a well bore in an earth formation that is lined or unlined with steel or any other material.

The first embodiment and key part of the solids exclusion system is a filter made of erosion resistant material having selected porosity, permeability and other flow characteristics for one or more specific intervals. The filter is manufactured in such a manner that the porosity and permeability can have selected values in both radial as well as longitudinal direction. This will enable the free passage of solids through the body of the filter, after they have passed the wall of the filter.

There can be at least two versions of the solids exclusion system, one for allowing flow from outside in, having a lower porosity outside than inside, and one from inside out having a lower porosity inside than outside. Also porosity and permeability differences in the vertical direction can be achieved by the manufacturing process, thus allowing programmable flow resistance in longitudinal direction along the filter axis.

The filter is composed of materials that are erosion resistant to any naturally occurring well bore fluid produced from earth formations. Furthermore, the filter is resistant against all commercially available acids used in the petroleum and natural gas industry, including, but not limited to HCl and HF. Materials that would possess that level of erosion resistance include, but are not limited to metals, organic and/or non-organic porous permeable materials. Said metals, organic and/or non-organic porous permeable materials that are sintered and/or atomically bonded are particularly suitable. Examples of each of those are sintered and/or atomically bonded steel or copper, sintered and/or atomically bonded carbon and various sintered and/or atomically bonded ceramics.

Sintered and/or atomically bonded material has properties that make it a particularly desirable choice. These can be provided in tubular form and can be made to specific porosity and permeability specifications. Sintered and/or atomic bonded materials can be quite weak in tensile and shear. This can be resolved, if deemed necessary, by steel or other reinforcements stipulated by the design of the assembly.

Another very attractive embodiment is that the novel solids exclusion system design of the present invention is part of an assembly that makes it possible to circulate flow at the outside of the filter by opening ports above and below the filter that permit fluid communication from inside the filter to the outside of the filter, or visa versa, to allow cleaning at the outside and removal of any impairment by means of circulation. This cleaning operation can be set in motion, in part, by contacting a heating coil with shape memory metal alloy rods. In the specification and claims, the term "shape memory alloy" is used to refer to an alloy that exhibits a shape-memory effect, wherein complete recovery of a deformation undergone at a particular temperature takes place at heating. The skilled person is able to select a composition of the alloy material that exhibits the required effects at the temperature prevailing in the well.

The solids exclusion system contains an internal sealing arrangement above the filter and an internal sealing arrangement below the filter, allowing injection of fluids below the filter entering the annular space between the solids exclusion system and the lined or unlined well bore, thereby enabling fluid transport at the outside of the filter, taking the returns at the top of the filter through the sealing arrangement located at that position, or visa versa.

Also within the scope of the present invention it is contemplated that a larger solids exclusion system can be comprised of multiple filter sections vertically being pressure separated from each other in the annular space between the individual filters, or filter sections, and lined or not lined well bore in an earth formation. Each filter section can consist of several sub filter sections, which might have different physical properties.

Further, the present invention contemplates the use of an internal (over the filter) straddling arrangement enabling selective movement of fluids in- or outwards of the filter or filter parts. This enables localized cleaning and/or movement from fluids of any type and property.

Each filter can be fitted with one polished bore at the top of the filter or filter sections and one at the bottom thereby enabling full straddling of that section resulting in zero production or injection, thereby providing a method of reservoir management.

The solids exclusion system can have an external sealing design on top of the filter and/or filter subsections and one below the filter or filter subsections thereby sealing the annular space between the solids exclusion system and the lined or not lined well bore, thereby blocking annular communication along the filter top and bottom. The external seals can be activated in such a manner that vertical movement of the solid exclusion system is zero at any given time of the activation process. This activation is made possible by the use of shape memory alloy as an activation means. (See WO0111185, WO0138692, incorporated by reference herein in the entirety.)

Within the scope of the present invention, the design of the solids exclusion system and especially the design of the external seals (See FIG. 2) can be configured in such a manner that all external seals can be deactivated without drilling or so-called "over washing" of the solids exclusion system. The latter can be achieved by using a coiled tubing and/or wireline unit to cut the section 5 (FIG. 2) at the position between the arrows 22*b* and 22*c* until that point that the memory metal bars (22*c*) are being cut. This will release the force from the elastomeric seal element 22*b*. The solids exclusion system can be held in place during its lifetime by at least one anchor, commonly a packer, at the bottom, and in case of tubing less completion, one non-rig/hoist intervention comprising an additional anchor, commonly a packer, at the top of the solids exclusion system.

It is desirable to obtain a water and/or hydrocarbon liquid flow through the permeable, porous and/or non-sealing parts of typically from 0 up to about 50 cubic meters liquid per day per meter of filter. It is desirable to obtain a flow of water and/or natural gas through the permeable, porous and/or non-sealing parts of typically from 0 to about 20,000 standard cubic meters gas per day per meter filter.

The solids exclusion system, and specifically the filter, should suitably allow passage of liquid of any density to a maximum of a density of typically 2.0 kg/liter at a maximum flow rate of typically 5 cubic meters per day per meter filter. Fluids of this type are typically used during installation and/or other well bore intervention activities.

The solids exclusion system is designed so that it can be installed and/or retrieved using state of the art industry rig and/or hoist equipment, procedures, and standards. The length of the solids exclusion system, or subsections thereof, will preferably not exceed the length of about typically 10 meters.

A suitable overall diameter of the solids exclusion system at any given position is less than the smallest drift diameter of the pipe through which the solids exclusion system must fully or partially pass. Sizes and tolerances for the pipe may vary.

In yet another embodiment of the present invention the solids exclusion system with circulation capabilities can be used to inject or produce any fluid and/or solids from the outside of the filter, as will be explained below.

The schematic drawing of FIG. 1 will serve to illustrate the invention disclosed herein. It is intended only as a means of illustration and should not be construed as limiting the scope of the invention in any way. Those skilled in the art will recognize many variations that may be made without departing from the spirit of the disclosed invention.

FIG. 1 demonstrates one embodiment utilizing the present invention in a well apparatus. Referring to FIG. 1 there is shown a solids exclusion system in a liner 1, though, as mentioned the invention can be used in a lined or unlined hole. The liner 1 has perforations 12 to permit fluid flow. Perforations can be made using oil field standard perforation guns, or they can be pre-drilled, or they can be acidized (See, for example, U.S. Pat. No. 5,103,911). The filter 11 of the present invention is situated between the lower assembly 2 and the upper assembly 15. The upper edge of the filter 11 is received into the upper assembly 15 and the lower edge of the filter 11 is received into the lower assembly 2. The permeable filter is made of ceramic, metallic or organic material subjected to a sintering or atomic bonding process, as used for the production of nano materials, that provides for any type of porosity required.

The upper edge of the filter 11 terminates in a ring 13 which is in contact with memory metal rods 14 which change shape when temperature is applied and which, in turn, are in contact with shut off opening sleeve 17 which has a fishing and/or locator and/or activation recess 16. In addition, sleeve 17 covers upper circulation port(s) 18. A fishing and/or locator and/or activation recess is also represented by 19.

In the lower assembly 2 a compression spring 3 holds disc 6 in the position to cover bottom port(s) 5. The port(s) 5 allow flow from the outside inwards or from the inside outwards if the disc 6 is in the lower position. Disc 6 can be permeable or impermeable. A rod assembly to hold the spring in place is represented by 4. A fixating plate for the rod assembly 4 is represented by 7. A wire line lock assembly, which is a standard tool used in the oil industry, is represented by 8–10, i.e. the latches, 8, the body, 9, and the fishing and locator groove, 10.

Figure 2:
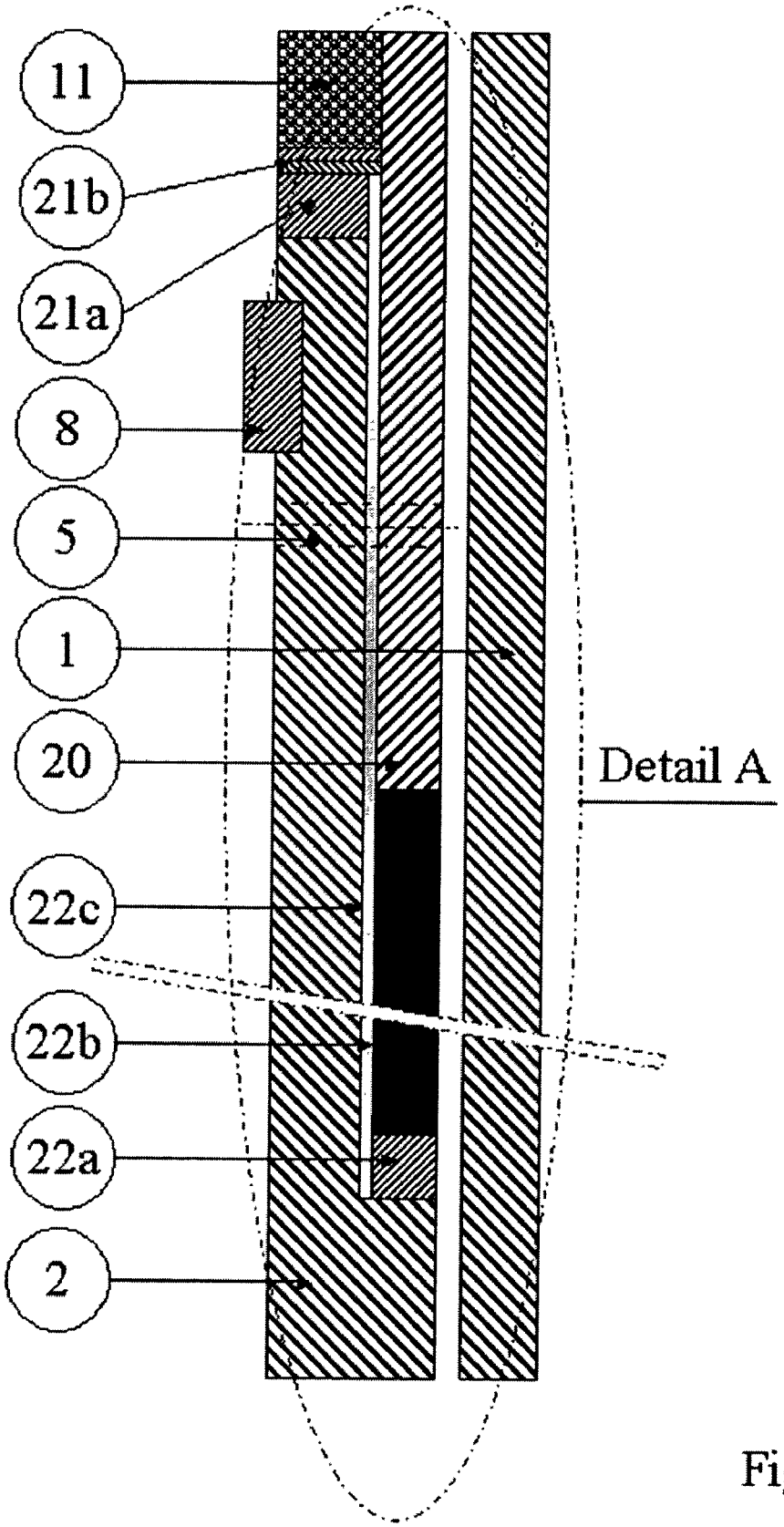
FIG. 2 is an enlarged view of one section of FIG. 1 showing a seal.

FIG. 2 is an enlarged view, showing detail A, where sealing material is represented by 22*b*, and memory metal rods 22*c*, used to activate the seals. The numbering of FIG. 2, corresponds with the numbering of FIG. 1. The seal 22 consists of a ring 21*a* connected to shape memory alloy rods 22*c* connected to, ring 22*a*. The sealing material 22*b* is enclosed by ring 22*a* and body 20. By applying heat to the internal of body 2, the shape memory alloy will contract and activate the seal. Length of contraction, varies typically between 4% and 8% of the length of the shape memory alloy bars. This allows someone knowledgeable in the art to dimension the seal material, seal length, and shape memory alloy rod length correctly.

Another very desirable embodiment of the present invention is that it is possible to circulate flow at the outside of the filter. Again, with reference to FIG. 1, this is achieved by running a heating coil to the position of the shape memory metal alloy rods 14.

When the shape memory metal alloy rods 14 are heated they contract and shift the sleeve 17, uncovering the upper port(s) 18. These ports can be filled with a porous ceramic or metal material. At the same time, or in a separate operation, the bottom port(s) 5 are opened by stinging a pipe, such as coil tubing known from the oil industry, with seals into the body 9. When pressuring this pipe up the disc 6 will move against the spring 3 and open up bottom port(s) 5. The opening of the bottom port(s) can also be achieved by pulling the lock assembly comprising 3, 4, 6, 7, 8, 9, and 10. An alternative method, not shown, is by mechanically pushing the disc 6 against the spring 3. This allows cleaning of the filter at the outside or removal of any impairment outside the filter by means of circulation in either direction. The cleaning fluid can be any. Suitable fluids can be hydrocarbon-based fluids, acids, scavengers, water-based fluids, gases and/or solvents, or combinations thereof.

Circulation can take place through the inner tube, not shown, via bottom port(s) 5 to upper ports 18 after which the fluid is produced back through the annular space between the inner tube, not shown, and the upper assembly 15. If reverse circulation is required then the mechanical lock open option of disc 6 needs to be used.

The port(s) 5 will automatically be closed as soon as the fluid flow through the ports stop and/or the pressure differential over element 6 counteracts the spring force.

A wire line tool is run to pull the sleeve 17 up, thereby covering the upper ports 18. (See WO0138689, incorporated by reference herein in the entirety.) FIG. 1 shows the ports in closed and open position.

The third embodiment of the invention, as mentioned above, is that the filter assembly can be used to inject or produce any fluid and/or solids from the outside of the filter 11 by running the inner tube, not shown, and stinging this into the lock assembly. With reference to FIG. 1, in order to flow back, the total lock assembly comprising 3, 4, 6, 7, 8, 9, and 10 needs to be pulled, the mechanical push open (not shown) variation needs to be installed. Another alternative to this assembly is an oil industry standard wire line set plug.

To ensure that the fluids have a defined circulation path seals 22 are placed between the outer tube 1 and the upper 15 and lower 2 assembly (FIG. 1). The solids exclusion system can be kept stationary in the tube 1 (FIG. 1) by the use of oil industry standard tubular and/or formation packers.

Figure 3:
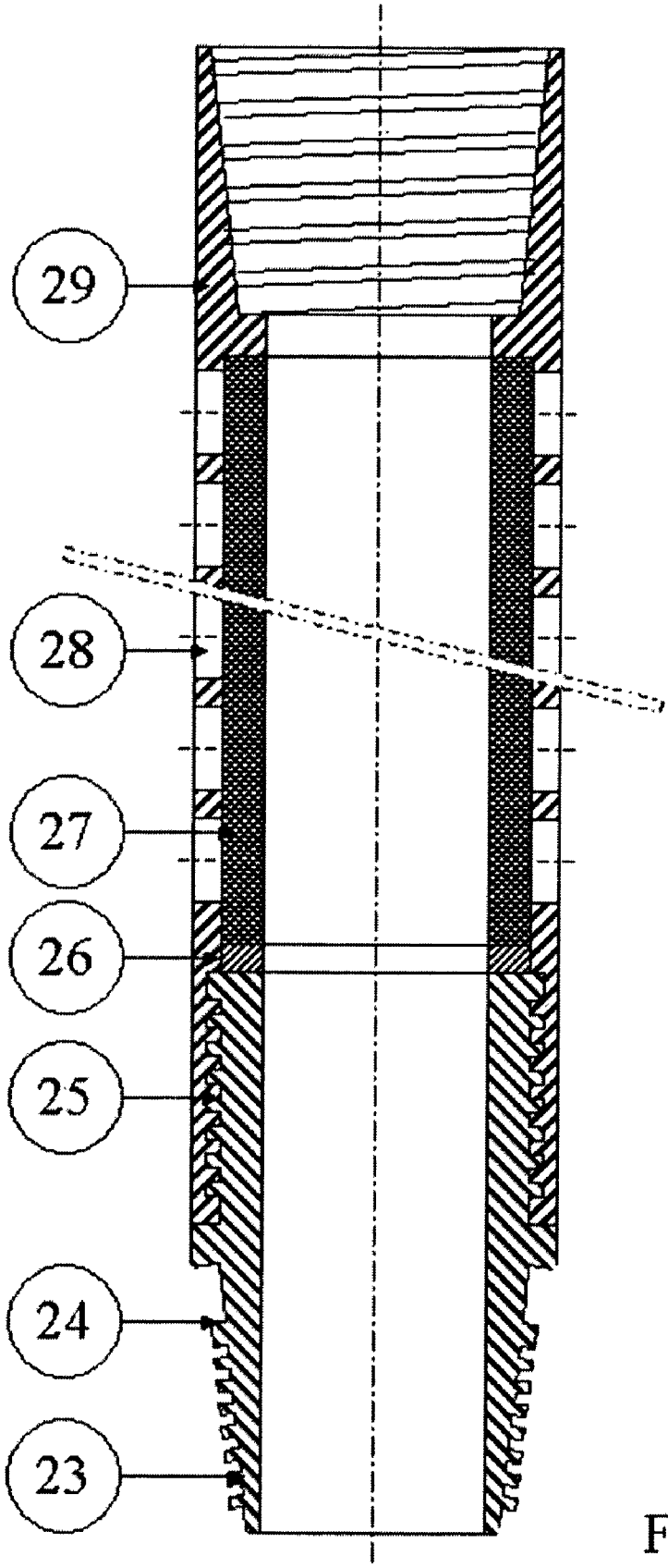
FIG. 3 is a longitudinal, cross-section view of one embodiment showing a sub-section of the screen with connections, pin and box at each end.

FIG. 3 shows a sub-section of the screen of which multiples can be connected together with or without intermittent blanks and/or sealing elements. FIG. 3 shows a standard oil field pin 23 with threads 24 and 25, which is screwed into embodiment 29 locking the screen 27 and filler ring(s) 26 in place. The top section of embodiment 29 shows a standard oil field box connection with threads allowing connection of multiple section and/or standard oil field tubular goods. The holes 28 (equal to item 20 of FIG. 1) allow passage of fluids whereby the number, dimension and position of the holes provide a certain spring force which can be controlled in combination with the dimensions of the filler ring(s) 26 and all other relevant dimensions, thus providing enhanced bending and/or axial tensile resistance of the assembly.

We claim:

1. A tool for use in excluding solids in a downhole production environment, the tool being placed in a borehole in an earth formation, the earth formation having at least one perforation in one or more zones of the formation for the production of hydrocarbons, the tool comprising:

a tool body having an axial and radial passage, a top, having at least one upper circulation port, and a bottom, having at least one bottom circulation port, and a sidewall filter media portion, the filter media having selected flow characteristics, including porosity, permeability and a pore size, chemical resistance, directional flow and shape properties, fluid circulating means for circulating fluids external to the tool body thereby enabling cleaning of the filter media and/or annular space formed between the tool body and formation wherein the fluid circulating means external to the tool body comprises:

(a) said top is in communication with memory metal rods which, when heated, activate a shut off opening sleeve that in a first position covers upper circulation port(s); and (b) said bottom is in communication with a disc, which in a first position covers lower circulation port(s), wherein said disc is held in position by a compression spring.

2. A tool as described in claim 1 wherein the means for circulating fluids external to the tool body further comprises:

(a) a ring around said top that is connected to said memory metal rods; a (b) said shut off opening sleeve having a recess that may be utilized for fishing, placement of a locator or for purposes of activation; and (c) said bottom is in communication with a wire line lock assembly, and said compression spring is held in place by a rod assembly.

3. A tool as described in claim 1 further including said tool allows for circulation from inside of the tool body to said upper or lower circulation port(s), thereby enabling cleaning of the tool from the inside outwards.

4. A tool as described in claim 1 wherein said disc is made of a material having selected flow characteristics, thereby allowing flow through said disc, thus enabling pressure equalization to facilitate opening of the circulation ports.

5. A tool as described in claim 1 wherein more than one tool is situated in series within said borehole, thereby enabling at least one of production or injection from more than one zone.

6. A tool as described in claim 5 further including magnet (s) in each tool when run in multiples to allow for positive identification of the tool.

7. A tool as described in claim 1 further including external shape memory metal seals.

8. A tool as described in claim 1 further including a means for circulating for circulating fluids external to the filter media, thereby enabling injection of chemicals and/or solids for the purpose of stimulating and/or cleaning the earth formation and/or the perforations.

* * * * *